US006957470B2

(12) United States Patent
Rivadeneira

(10) Patent No.: US 6,957,470 B2
(45) Date of Patent: Oct. 25, 2005

(54) MULTIPLE-ROLLER CORNER PAINTING TOOL

(76) Inventor: Hugo P. Rivadeneira, 511 Goldenrod Ter., Westminster, MD (US) 21157

( * ) Notice: Subject to any disclaimer, the term of this patent is extended or adjusted under 35 U.S.C. 154(b) by 73 days.

(21) Appl. No.: 10/731,753

(22) Filed: Dec. 8, 2003

(65) Prior Publication Data

US 2005/0120501 A1 Jun. 9, 2005

(51) Int. Cl.[7] ..... B05C 17/00; B05C 17/02

(52) U.S. Cl. ..... 15/230.11; 15/144.2; 492/13; 492/19

(58) Field of Search ..... 15/230.11, 230.16, 15/230, 144.2, 144.1; 492/13, 17, 19; D4/119, D4/122

(56) References Cited

U.S. PATENT DOCUMENTS

| | | | | | |
|---|---|---|---|---|---|
| 2,788,539 | A | * | 4/1957 | Santina | 15/230.11 |
| 2,813,292 | A | * | 11/1957 | McLendon | 15/230.11 |
| 2,824,328 | A | * | 2/1958 | Bedford | 15/230.11 |
| 2,904,813 | A | * | 9/1959 | Schleicher | 15/230.11 |
| 3,263,260 | A | * | 8/1966 | Filler | 15/230.11 |
| 3,358,312 | A | * | 12/1967 | Parr | 15/230.11 |
| 3,649,986 | A | * | 3/1972 | Dahlund | 15/230.11 |
| 4,335,484 | A | * | 6/1982 | Ridge et al. | 15/230.11 |
| 5,035,022 | A | * | 7/1991 | Iuliano et al. | 15/118 |
| 5,293,662 | A | | 3/1994 | Newman, Sr. et al. | |
| 5,386,610 | A | | 2/1995 | Batanjski | |
| D405,958 | S | * | 2/1999 | Mollack | D4/122 |
| 6,000,090 | A | * | 12/1999 | Sutherland | 15/230.11 |
| 6,045,282 | A | * | 4/2000 | Begin | 401/197 |
| 6,219,877 | B1 | | 4/2001 | Lowrey et al. | |
| 2003/0005536 | A1 | | 1/2003 | Kim | |
| 2003/0196286 | A1 | | 10/2003 | Pyles | |
| 2003/0233721 | A1 | | 12/2003 | Prince et al. | |

* cited by examiner

*Primary Examiner*—Gary K. Graham
(74) *Attorney, Agent, or Firm*—Law Offices of Royal W. Craig

(57) ABSTRACT

Disclosed herein is a corner painting tool, typically comprising at least four replaceable rollers pivotally attached to a handle, that provides for the painting of the two adjoining surfaces forming a typical 90° interior corner in an even and efficient manner. Each pair of rollers is detachably attached to one of two axle-bearing elements that are, in turn, rigidly affixed at opposite ends of a connector bar. The fixed relationship between the connector bar and the axle-bearing elements serve to position each pair of rollers at a 90° angle to the other. A handle is pivotally attached at the midpoint of the connector bar. Attachment at the bar's midpoint serves to locate the pivot point as close as possible to the inside corner formed by the rollers, thereby maximizing the stability of the overall assembly during use. The pivoting connection provides a user with the flexibility of operation needed to reliably move the painting tool along an interior corner surface from virtually any location between the adjoining surfaces.

15 Claims, 4 Drawing Sheets

MULTIPLE-ROLLER CORNER PAINTING TOOL

BACKGROUND OF THE INVENTION

1. Field of the Invention

The present invention relates to painting tools and, more particularly, to a multiple-roller painting tool that provides for the painting of both walls adjoining an interior angle/corner evenly and simultaneously.

2. Description of the Background

Mainstream interior decorating relies heavily on painting, and a variety of different tools have evolved to help in accomplishing the same. One of the places where painting takes considerable time and effort is the typical internal angle/corner where two surfaces meet. Painting internal angles/corners is typically accomplished by manually applying paint with a brush using a constant and generous amount of paint with overlapping strokes in order to cover strips typically four inches wide along both adjoining surfaces. Moreover, tall walls increase the amount of time needed to paint because the use of a ladder is required in order to reach the top of the internal corner and adjoining walls.

A typical right angle corner where two interior surfaces meet can also be painted manually using the corner painting tool described in U.S. Pat. No. 5,293,662 to Newman, Sr. et al. which is manufactured and sold by Mr. Longarm, Inc. of Greenwood, Mo. The Newman, Sr. et al. patent discloses a pad formed as a 90° angle that fits within the profile of an internal corner/angle. The pad is attached to a handle that swivels 180° along the direction in which the paint is being applied, and can make use of an extension pole in order to reach high walls.

Another device for painting internal corners is a 3" diameter by 1" long foam roller formed with the edge/end in a "V"-shape that may be used to apply paint to both surfaces in narrow strips. A small roller with a handle and a covered end is also useful for this purpose, particularly in close quarters where its lightweight construction helps to speed up the painting process.

Unfortunately, the aforementioned devices possess significant deficiencies and fall well short of the optimum painting tool. While the corner painting tool disclosed in the Newman, Sr. et al. patent provides for the painting of inside corners (including corners formed by tall walls where the use of an extension pole is required), a specially adapted tray is needed to get paint onto the two pads, and the pads must be constantly replenished with paint. Furthermore, the handle remains rather rigid with respect to motion to the left or right of the direction in which the paint is being applied, thereby offering little flexibility for movement or body position during use. In order to correctly apply the paint to the corner, a user must be positioned roughly midway between the two walls (i.e. at a location roughly 45° from either wall surface). The primary shortcoming of the foam roller is the very narrow (1" wide) strips of paint that are applied to the two surfaces. This causes problems during any subsequent painting of either surface due to the need to come very close to the adjoining surface. If the painter is not careful, the painting tool, typically a roller, being used on one surface will contact the other surface and create an undesirable mark (one that will require additional time/labor to be corrected). Finally none of aforementioned tools possess the flexibility of design required to apply paint to just one of the surfaces in a corner.

Therefore, there remains a need for a corner painting tool that includes a handle connection that allows motion in multiple directions, and lays down a reasonably wide strip of paint along one or both of the adjoining surfaces without requiring constant replenishment of the paint. A device of this sort should not require special accessories (e.g. custom configured trays) to assist in getting the paint onto it. To the best of the knowledge of the present inventor, no such apparatus exists. An apparatus of this type should, in addition to the capabilities outlined above, be fabricated of strong, lightweight materials, and be economical to manufacture and sell.

SUMMARY OF THE INVENTION

It is, therefore, the primary object of the present invention to provide a corner painting tool that assists in applying paint to adjoining surfaces forming an interior corner in an even and efficient manner.

It is another object of the present invention to provide a corner painting tool that allows a user to apply paint to an interior corner from virtually any location between the adjoining surfaces, thereby providing for more freedom of movement.

It is yet another object of the present invention to provide a corner painting tool that lays down a reasonably wide strip of paint along one or both of the adjoining surfaces without requiring constant replenishment of the paint.

Still another object of the present invention is to provide a corner painting tool that may be used to paint high, or hard to reach, areas via the attachment of an extension pole to the tool's handle.

It is another object of the present invention to provide a corner painting tool that does not require special accessories, such as custom configured trays, to assist in getting the paint onto it.

It is another object of the present invention to provide a corner painting tool that may be used to apply paint to only one of the two adjoining surfaces forming a corner.

Yet another object of the present invention is to provide a corner painting tool that is fabricated of strong, lightweight materials.

It is another object of the present invention to provide a corner painting tool that is economical to manufacture and sell.

These and other objects are accomplished by a corner painting tool, typically comprising at least four replaceable rollers pivotally attached to a handle, that provides for the painting of the two adjoining surfaces forming a typical 90° interior corner in an even and efficient manner. Each pair of rollers is detachably attached to one of two axle-bearing elements (which may be "U"-shaped) that are, in turn, rigidly affixed at opposite ends of a connector bar. The fixed relationship between the connector bar and the axle-bearing elements serve to position each pair of rollers at a 90° angle to the other and in a staggered configuration. A handle is pivotally attached at the midpoint of the connector bar. Attachment at the bar's midpoint serves to locate the pivot point as close as possible to the inside corner formed by the rollers, thereby maximizing the stability of the overall assembly during use. The pivoting connection allows the handle to pivot, with respect to the connector bar, up to 180° along the direction of the interior corner and up to nearly 90° left-to-right. The pivoting connection provides a user with the flexibility of operation needed to reliably move the painting tool along an interior corner surface from virtually any location between the adjoining surfaces.

Also provided is a removable paint shield that may be temporarily attached to the present invention to facilitate the selective application of paint to only one of the adjoining surfaces forming the interior corner. Finally, an extension pole may be attached at one end of the handle to increase the reach of the present invention, thereby further enhancing its utility. The present invention is fabricated of strong, lightweight materials to provide the durability required by the nature of its usage, and can be economically manufactured and sold.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

Figure 1:
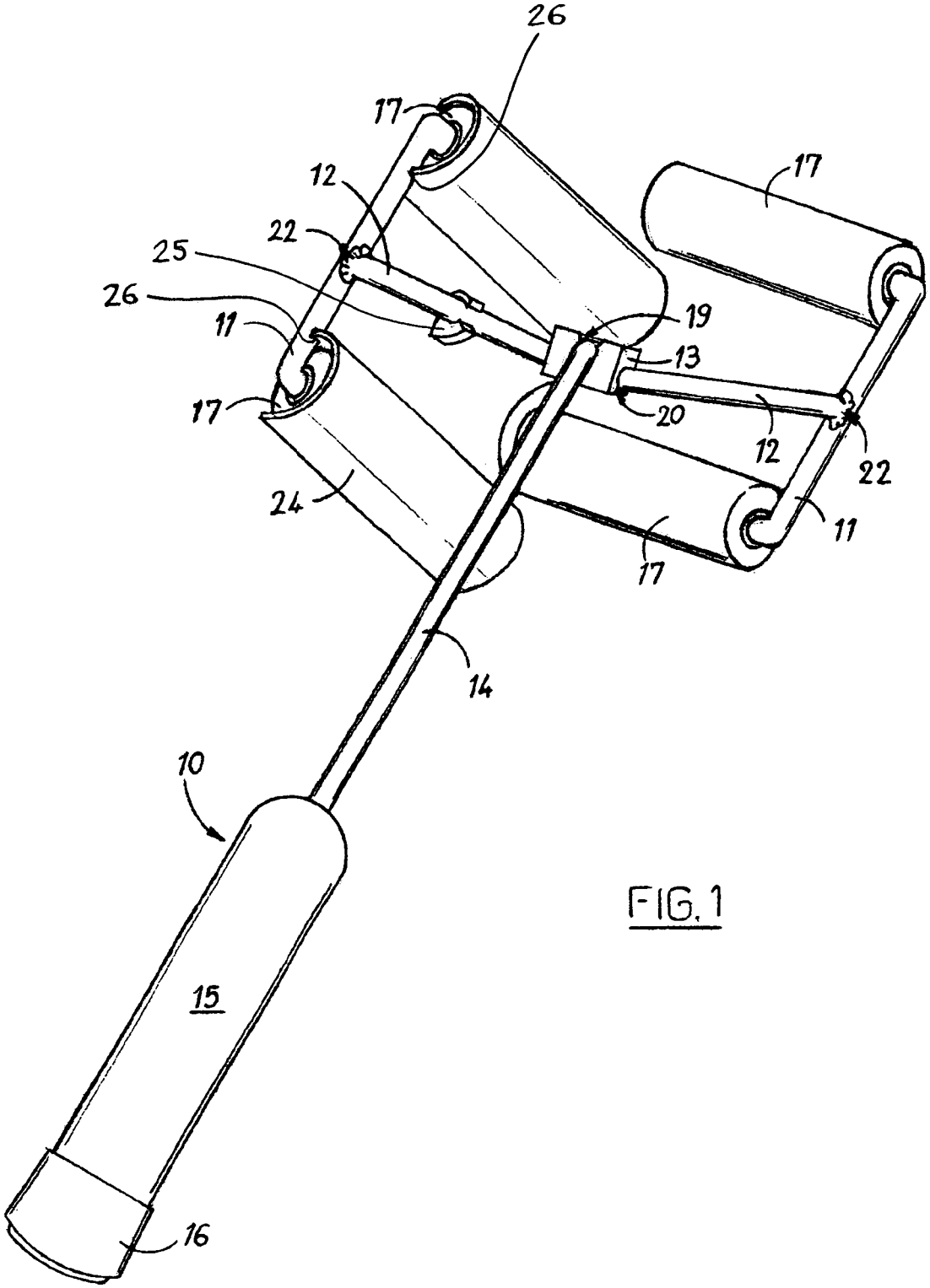
FIG. 1 is a side perspective view of a corner painting tool 10 according to a first embodiment of the present invention.
Figure 2:
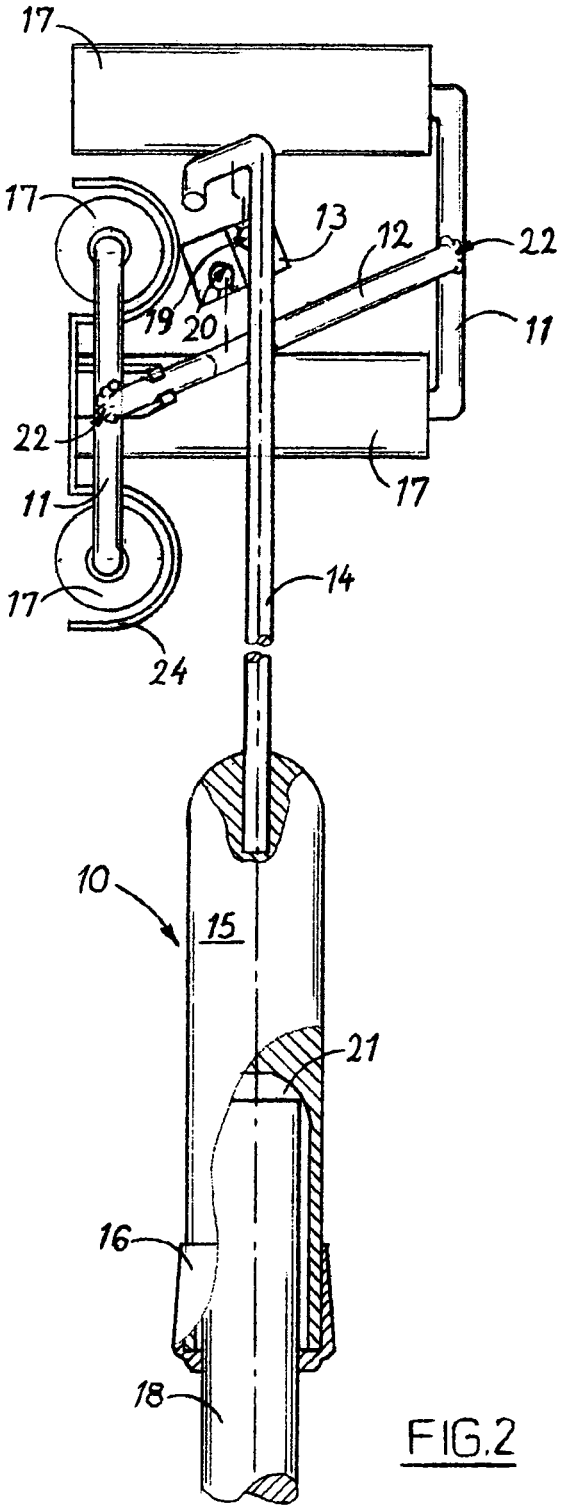
FIG. 2 is a partially cross-sectioned, partially exploded view of the corner painting tool 10 of FIG. 1, shown with a pivoting joint 13 detached from a connector bar 12 and a connector arm 14 detached from the pivoting joint 13.
Figure 3:
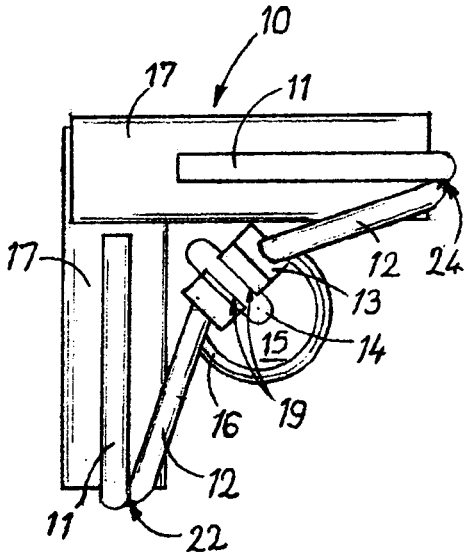
FIG. 3 is an end perspective view of the corner painting tool 10 of FIGS. 1 and 2, shown with rollers 17 on only two of the four parallel axles formed on the axle-bearing elements 11.

FIGS. 1–3 are, respectively, side, partially cross-sectioned/exploded, and end perspective views of a corner painting tool 10 according to a first embodiment of the present invention. The tool 10 generally comprises a plurality of rollers 17, at least two axle-bearing elements 11, a connector bar 12, a pivoting joint 13, a connector arm 14, and a handle 15.

As illustrated, the preferred embodiment employs two axle-bearing elements 11 each formed integrally to define a pair of parallel axles joined together by a crossbar 11, the crossbar 11 of each axle-bearing element being fixedly attached to the connector bar 12 such that the parallel axles of the two axle-bearing elements 11 are directed inward toward each other at substantially a right angle orientation. One skilled in the art will appreciate that additional axles (and rollers 17) may protrude from each crossbar 11, thereby allowing for additional sets of rollers on elements 11, effectively increasing the total number of rollers to any quantity greater than four. Thus, axle-bearing elements 11 may include the basic U-shape as in the illustrated configuration, but may incrementally add additional axles to form UU- or UUU-shapes as desired to wield additional sets of rollers on elements 11. It is worth noting that the axle-bearing elements 11 do not have to be U-shaped (or multiples thereof), it is only important that the axles, formed at the distal ends of the elements 11, are parallel.

The two axle-bearing elements 11 are fixedly attached, at any point 22 along the length of their crossbars, at each end of a connector bar 12. The connector bar 12 is shaped substantially as a shallow "V", with a short, straight section formed at the bottom of the "V". The distal ends of each axle-bearing element 11 are positioned at an angle of 90° to the element's crossbar and are, therefore, parallel to one another. The axle-bearing elements 11 are attached to the connector bar 12 such that the distal ends of one element 111 are substantially perpendicular (at right angles) to the distal ends of the other element 11, with the short, straight section formed at the bottom of the bar's V-shape positioned within the 90° angle formed by the distal ends. The elements 11 and bar 12 are preferably fabricated of cylindrical sections of a commercially available, rigid metal that is chemically resistant to, or treated to resist the effects of, all or most types of paints, solvents, and/or adhesives. The fixed attachment between the elements 11 and the bar 12 is preferably accomplished via welding. However, other materials, such as rigid, chemically-resistant plastics, and other attachment means, such as gluing or the molding of the elements 11 and bar 12 as a unitized component, may be utilized.

A commercially available, replaceable paint roller 17 is fitted over each distal end of each axle-bearing element 11. Each roller 17 is equipped with a porous external surface fabricated of a flocked fabric or synthetic foam chosen for its paint absorbing/applying characteristics. The distal end of each roller 17 may also be wrapped with a similar material to assist in the application of paint to one adjoining surface without marring the other surface.

The length of the axles formed by the distal ends of elements 11 are such that the rollers 17 fit as shown in FIG. 3, with an end of each roller 17 proximate the crossbar, yet free to rotate as required to apply paint. Each crossbar, as shown in FIG. 2, is preferably just long enough to provide clearance for the rollers 17, positioned in a staggered, perpendicular orientation, to work properly without touching one another. The aforementioned arrangement of the axle-bearing elements 11 allows the rollers 17 to be accommodated within the junction, typically a 90° angle, of two walls. The staggered arrangement of the axle-bearing elements 11 of the first embodiment may take the form of the "straddling" arrangement shown in the alternative embodiment of FIGS. 4–6 discussed below.

The spacing between the two axle-bearing elements 11, defined by the connector bar 12, is such that the distal ends of the four rollers 17 do not directly contact (i.e. just clear) the adjoining wall as they apply paint to one wall. However, the spacing should not be such that the corner painting tool 10 is prevented from actually painting the entire corner by virtue of the paint squeezed out of distal ends of the rollers 17 due to the forces exerted by the user.

One end of a connector arm 14 is pivotally attached to a pivot joint 13, which is, in turn, pivotally attached to the connector bar 12 proximate the short, straight section formed at the bottom of the bar's V-shape. The other end of the connector arm 14 is fixedly attached at an end of a handle 15, and an end cup 16 is removably attached at another end of the handle 15.

The pivot joint 13 is preferably defined by channels 19, 20 located in, respectively, its top and bottom surfaces. The channels 19, 20 are positioned perpendicular to one another and are formed such that the cylindrical connector arm 14 may be seated within the channel 19 located in the top surface and the short, straight section of the cylindrical connector bar 12 may be seated (i.e. press fit) within the channel 20 located in the bottom surface. Once the arm 14 or bar 12 is seated in its respective channel 19, 20, a slight friction fit is created that allows the arm 14 or bar 12 to remain stationary within its channel 19, 20 unless an external force is applied by a user. The pivoting joint 13 allows the handle 15 to pivot "universally", with respect to the connector bar 12, up to 180° along the direction of the interior corner and up to nearly 90° left-to-right (i.e. between the adjoining surfaces defining the interior corner). This provides an overall wide range of motion, and allows a user of the corner painting tool 10 the freedom to apply paint along a corner from virtually any angular position of the handle 15 between the adjoining surfaces of the corner to be painted.

To maximize the stability of the painting tool 10 during use, the pivot joint 13 attachment to the short, straight section at the bottom of the V-shaped connector bar 12 is preferably located as close as possible to the 90° corner formed by the distal ends of the rollers 17 without actually contacting the surface of the rollers 17.

The end of the connector arm 14 pivotally connected to the joint 13 is formed with two angles to facilitate its installation in the channel 19 and to prevent the arm 14 from inadvertently sliding out of that channel 19.

The connector arm 14 is preferably fabricated of a cylindrical section of a commercially available, rigid metal that is chemically resistant to, or treated to resist the effects of, all or most types of paints, solvents, and/or adhesives. The pivot joint 13 is preferably fabricated of a commercially available metal that is chemically resistant to, or treated to resist the effects of, all or most types of paints, solvents, and/or adhesives. However, other materials, such as rigid, chemically-resistant plastics, may be utilized for the arm 14 and the joint 13. The handle 15 is preferably molded from a commercially available, rigid plastic that is chemically resistant to, or treated to resist the effects of, all or most types of paints, solvents, and/or adhesives. The fixed attachment between the arm 14 and the handle 15 is preferably accomplished via gluing. However, other attachment means, such as the molding of the arm 14 and handle 15 as a unitized component, may be utilized. Alternatively, the handle 15 may be an assembly of two or more components fabricated of non-plastic materials (e.g. wood, aluminum) that are chemically resistant to, or treated to resist the effects of, all or most types of paints, solvents, and/or adhesives.

The reach of the painting tool 10 may be increased, to paint high or hard to reach areas, by employing an extension pole 18 as partially shown in FIG. 2. The extension pole 18 may be a cylindrical length of wood or any commercially available plastic, or metal, rod or tube. The extension pole 18 may be connected to the painting tool 10 through a hole 21 located in one end of handle 15. The hole 21 is typically formed with a diameter slightly larger than that of the extension pole 18. The closed end of the hole 21 is conical or round in order to keep the typically round tip of extension pole 18 tip from moving around inappropriately. A commercially available, rubber end cup 16, open at both ends, that fits over the end of the handle 15 while contacting the outside surface of the extension pole 18 may be used to maintain the connection between the handle 15 and the pole 18. The end cup 16 may be similar to the floor protector cups that attach to the legs of furniture. The open ends of the cup 16 stretch to encompass the end of the handle 15 and the outside surface of the pole 18, thereby maintaining a friction fit between the handle 15 and the pole 18.

An optional paint shield 24, meant to assist in minimizing the splashing of paint during the application process, may be detachably attached to the connector bar 12 via a clip 25 formed on the shield 24. Proper alignment of the shield 24 is maintained by two semi-circular notches 26 that conform to the outer surface of the axle-bearing elements 11. The paint shield 24 is preferably a plastic, molded component.

In use, with reference to FIGS. 1–3, paint may be applied to the rollers 17 by cycling the present invention back and forth in any commercially available paint tray. A two-stage process is required because only two of the rollers 17 at a time may be immersed in the paint in the tray. Once the rollers 17 are holding a sufficient quantity of paint, the present invention may be introduced into the corner such that each pair of rollers 17 contacts one of the adjoining walls. The painting tool 10 may then be rolled along the corner to apply paint simultaneously to both of the adjoining walls. The location and operation of the pivoting joint 13 allows the user of the painting tool 10 to be positioned at any point between the walls while applying paint to the corner evenly and efficiently.

The first embodiment of the apparatus 10 may be converted for use in applying paint to only one of the adjoining walls, in a manner similar to that of the alternative embodiment 110 discussed below, by simply removing two of the commercially-available rollers 17 (those positioned to paint one of the two walls), and replacing them with two incompressible rollers 117 and a paint shield 124 (see FIGS. 4–6).

Figure 4:
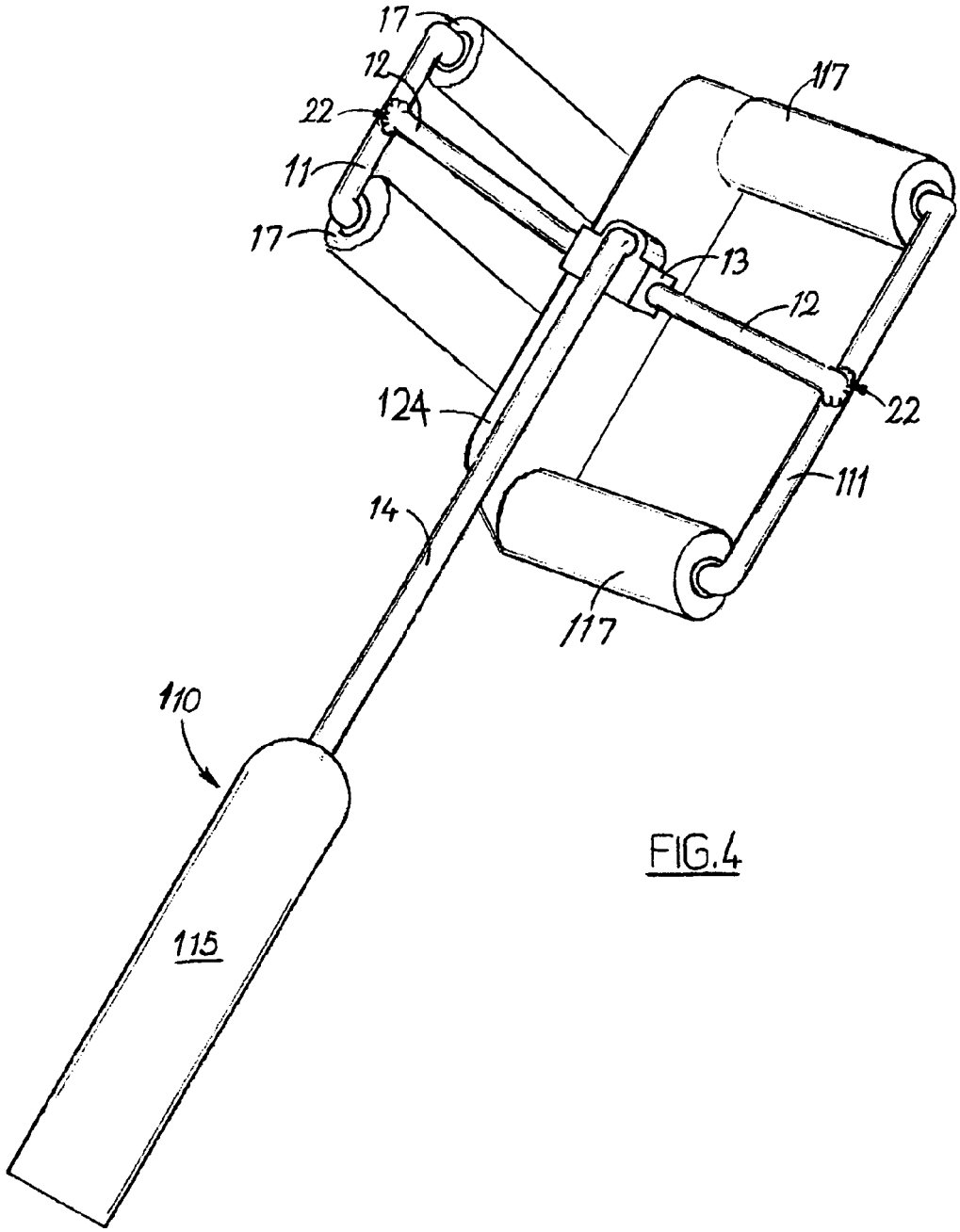
FIG. 4 is a side perspective view of a corner painting tool 110 according to an alternative embodiment of the present invention.
Figure 5:
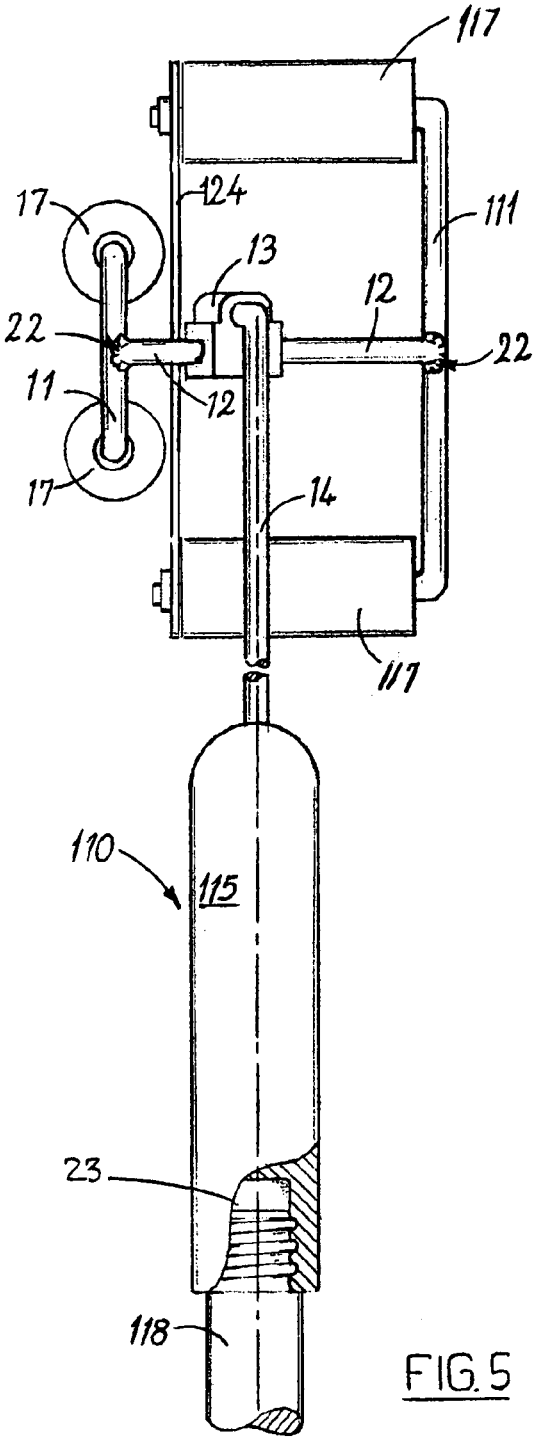
FIG. 5 is a side, partially cross-sectioned view of the corner painting tool 110 of FIG. 4.
Figure 6:
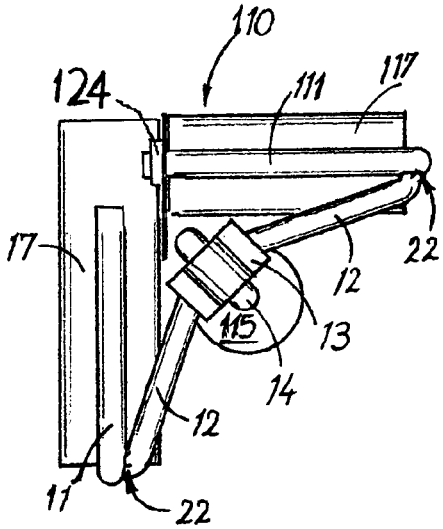
FIG. 6 is an end perspective view of the corner painting tool 110 of FIGS. 4 and 5, shown with rollers 17, 117 on only two of the four parallel axles formed on the axle-bearing elements 11, 111.

FIGS. 4–6 are, respectively, side, partially cross-sectioned, and end perspective views of a corner painting tool 110 according to an alternative embodiment of the present invention. The tool 110 generally comprises a plurality of rollers 17, 117, two axle-bearing elements 11, 111, a connector bar 12, a pivoting joint 13, a connector arm 14, and a handle 115.

In the alternative embodiment, which is configured for use in painting only one of the two adjoining walls forming a corner, two rollers 17 are positioned side-by-side with the other two rollers 117 straddling them. Unlike those of the primary embodiment, the axle-bearing elements 11, 111 are not identical in size in order place the rollers 17, 117 in the straddling configuration described immediately above. The elements 11, 111 position the two rollers 17 such that they are perpendicular to the other two rollers 117.

Two elements of the painting tool 110, the paint shield 124 and the rollers 117, are specifically required and designed to facilitate the painting of only one wall. The paint shield 124, preferably a molded plastic component and meant to prevent the application of paint to one of the walls during the application process, may be detachably attached at the distal ends of the parallel axles formed in axle-bearing element 111 (or, alternatively, proximate the distal ends of the rollers 117) via clips (not shown in the Figures) formed proximate the ends of the shield 124.

The rollers 117 are fabricated of an incompressible material such as plastic. The rollers 117 are intended only as support for the painting tool 110 against the wall that is not to be painted and are, therefore, not made of materials intended to absorb/apply paint.

Alternate handle 115 may be formed with an internally threaded hole 23 capable of receiving an alternative extension pole 118 with external threads formed on one end. The alternative embodiment of the apparatus 110 may be converted for use in applying paint to both walls by simply removing the shield 124 and replacing the incompressible rollers 117 with commercially-available rollers 17.

In use, paint may be applied to the rollers 17 by cycling the alternative painting tool 110 back and forth in any commercially available paint tray. Once the rollers 17 are holding a sufficient quantity of paint, the present invention may be introduced into the corner such that the rollers 17 contact the wall that is to be painted. Simultaneously, the incompressible rollers 117 contact the wall that is not to be painted. The painting tool 110 may then be rolled along the corner to apply paint only to the selected wall. The location and operation of the pivoting joint 13 allows the user of the painting tool 110 to be positioned at any point between the walls while applying paint to the appropriate wall evenly and efficiently.

Additionally, the alternative corner painting tool 110 of FIGS. 4–6 may be configured such that the position of the rollers 17, 117 is reversed in order to paint only the opposite wall.

As is readily perceived in the foregoing description, the present invention's design is simple and scalable (i.e. it may be varied in size to fit various applications including corners formed with angles of other than 90°), and may be economically manufactured and sold. The present invention is fabricated of strong, lightweight materials to provide the durability required by the nature of its usage.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A corner painting apparatus comprising:

a handle;

a connector arm fixedly attached to said handle;

a joint pivotally attached to said connector arm;

a connector bar pivotally attached to said joint;

two axle-bearing elements each defined by at least two parallel axles joined together by a crossbar, said crossbar of each axle-bearing element being attached to said connector bar such that the parallel axles of said two axle-bearing elements are directed inward toward each other at substantially a right angle orientation; and a plurality of rollers, each roller being rotatably mounted on a corresponding axle of each of said axle-bearing elements;

wherein said pivotal attachments between said connector arm and said joint, and said joint and said connector bar allows said handle to pivot universally with respect to said rollers allowing a user of said corner painting apparatus to apply paint along a corner from virtually any angular position of said handle.

2. The corner painting apparatus according to claim 1, further comprising an end cup detachably attached to said handle.

3. The corner painting apparatus according to claim 2, further comprising an extension pole detachably attached to said end cup.

4. The corner painting apparatus according to claim 1, further comprising an extension pole detachably attached to said handle.

5. The corner painting apparatus according to claim 1, further comprising a paint shield detachably attached to said connector bar.

6. The corner painting apparatus according to claim 1, wherein said joint comprises;

a first channel formed in a first surface of said joint with said connector arm being rotatably seated within said first channel; and a second channel formed in a second surface of said joint, said second channel being oriented perpendicular to said first channel and said connector bar being rotatably seated within said second channel.

7. The corner painting apparatus according to claim 6, wherein said connector bar is formed substantially as a shallow "V" with a short, straight section formed at the bottom of said "V".

8. The corner painting apparatus according to claim 7, wherein said joint is pivotally attached to said connector bar along said short, straight section.

9. The corner painting apparatus according to claim 8, wherein said short, straight section is positioned within said substantially right angle formed by said parallel axles as close as possible to the substantially right angle without actually contacting said rollers.

10. The corner painting apparatus according to claim 1, wherein said axles of each axle bearing element are positioned at an angle of 90° to their respective crossbar and are, therefore, parallel to one another.

11. The corner painting apparatus according to claim 1, wherein said axle-bearing elements are fixedly attached to said connector bar such that distal ends of one of said elements are perpendicular to distal ends of the other of said elements.

12. The corner painting apparatus according to claim 1, wherein said crossbars are sized to provide clearance for said rollers to work properly without touching one another.

13. The corner painting apparatus according to claim 12, wherein said rollers are staggered.

14. The corner painting apparatus according to claim 1, wherein each of said rollers is defined by a porous external surface chosen for certain paint absorbing/applying characteristics.

15. The corner painting apparatus according to claim 1, wherein two of said plurality of rollers are fabricated of an incompressible material.

* * * * *